US010364828B2

(12) United States Patent
Ikeguchi et al.

(10) Patent No.: US 10,364,828 B2
(45) Date of Patent: Jul. 30, 2019

(54) VARIABLE STATOR VANE MECHANISM

(71) Applicant: KAWASAKI JUKOGYO KABUSHIKI KAISHA, Kobe-shi, Hyogo (JP)

(72) Inventors: Takuya Ikeguchi, Kobe (JP); Kentaro Nakayama, Nishinomiya (JP)

(73) Assignee: KAWASAKI JUKOGYO KABUSHIKI KAISHA, Hyogo, Kobe-shi (JP)

( * ) Notice: Subject to any disclaimer, the term of this patent is extended or adjusted under 35 U.S.C. 154(b) by 459 days.

(21) Appl. No.: 15/184,439

(22) Filed: Jun. 16, 2016

(65) Prior Publication Data

US 2016/0290361 A1 Oct. 6, 2016

Related U.S. Application Data

(63) Continuation of application No. PCT/JP2014/081170, filed on Nov. 26, 2014.

(30) Foreign Application Priority Data

Dec. 19, 2013 (JP) ..... 2013-262426

(51) Int. Cl.
*F01D 17/16* (2006.01)
*F04D 29/56* (2006.01)

(52) U.S. Cl.
CPC ..... *F04D 29/563* (2013.01); *F01D 17/162* (2013.01)

(58) Field of Classification Search
CPC ..... F04D 29/563; F01D 17/16; F01D 17/162; F01D 17/165; F01D 25/166; F01D 25/28
See application file for complete search history.

(56) References Cited

U.S. PATENT DOCUMENTS 2,933,234 A * 4/1960 Neumann ..... F01D 17/162 415/149.4
6,092,984 A 7/2000 Bouyer
(Continued)

FOREIGN PATENT DOCUMENTS

CN 101050728 A 10/2007
DE 24 26 824 A1 1/1976
(Continued)

OTHER PUBLICATIONS

Jin Feng, "Milling Machine Jig", China Machine Press, Sep. 1972, pp. 35-36 (4 pgs. total).
(Continued)

*Primary Examiner* — Carlos A Rivera
*Assistant Examiner* — Danielle M. Christensen
(74) *Attorney, Agent, or Firm* — Sughrue Mion, PLLC

(57) ABSTRACT

To provide a variable stator vane mechanism, for an axial flow compressor, which is excellent in durability, has a simple structure, and is realized at low cost. The variable stator vane mechanism for adjusting a mounting angle of a stator vane of an axial flow compressor includes: an arm coupled to the stator vane; a rotation ring coupled to one end portion of the arm and located at an outer surface of a casing of the axial flow compressor; a driving machine configured to rotate the rotation ring to cause the stator vane to pivot via the arm; and a friction pad mounted on the casing. The rotation ring is in frictional contact with the friction pad.

7 Claims, 5 Drawing Sheets

(56) References Cited

U.S. PATENT DOCUMENTS

| | | | | |
|---|---|---|---|---|
| 7,198,454 | B2 * | 4/2007 | Evans | F01D 17/162 415/12 |
| 7,223,066 | B2 * | 5/2007 | Rockley | F01D 17/162 415/160 |
| 7,588,415 | B2 | 9/2009 | Giaimo et al. | |
| 7,901,178 | B2 | 3/2011 | Giaimo et al. | |
| 8,123,472 | B2 * | 2/2012 | Redgwell | F01D 17/162 415/155 |
| 8,668,444 | B2 | 3/2014 | Jarrett, Jr. et al. | |
| 8,714,916 | B2 | 5/2014 | Jarrett, Jr. et al. | |
| 8,794,910 | B2 * | 8/2014 | Gasmen | F01D 17/162 415/160 |
| 9,822,651 | B2 * | 11/2017 | LeBlanc | F01D 17/162 |
| 2007/0020091 | A1 | 1/2007 | Giaimo et al. | |
| 2009/0285673 | A1 | 11/2009 | Giaimo et al. | |
| 2012/0076641 | A1 | 3/2012 | Jarrett, Jr. et al. | |
| 2012/0076658 | A1 | 3/2012 | Jarrett, Jr. et al. | |
| 2013/0108415 | A1 | 5/2013 | Hashimoto et al. | |
| 2014/0064910 | A1 | 3/2014 | Velampati et al. | |

FOREIGN PATENT DOCUMENTS

| | | | |
|---|---|---|---|
| EP | 1 010 918 | A2 | 6/2000 |
| JP | 2009-30719 | A | 2/2009 |
| JP | 2009-156446 | A | 7/2009 |
| JP | 2010-1821 | A | 1/2010 |
| JP | 2012-72763 | A | 4/2012 |
| JP | 2012-72764 | A | 4/2012 |
| JP | 2013-96341 | A | 5/2013 |
| JP | 2013-113420 | A | 6/2013 |
| JP | 2014-47783 | A | 3/2014 |
| WO | 2005/0452502 | A1 | 5/2005 |

OTHER PUBLICATIONS

Communication dated Dec. 11, 2017, from the State Intellectual Property Office of People's Republic of China in counterpart Application No. 201480068276.1.

JPO Office Action for Application No. 2013-262426 dated Aug. 5, 2014.

JPO Office Action for Application No. 2013-262426 dated Mar. 31, 2015.

International Search Report for PCT/JP2014/081170 dated Dec. 22, 2014 [PCT/ISA/210].

English Translation of International Preliminary Report on Patentability and Written Opinion dated Jun. 30, 2016, issued by the International Searching Authority in application No. PCT/JP2014/081170.

Communication dated Aug. 9, 2017 from the European Patent Office in counterpart Application No. 14871329.0.

Communication dated Apr. 6, 2017 issued by the State Intellectual Property Office of People's Republic of China in counterpart application No. 201480068276.1.

* cited by examiner

VARIABLE STATOR VANE MECHANISM

CROSS REFERENCE TO THE RELATED APPLICATION

This application is a continuation application, under 35 U.S.C. § 111(a), of international application No. PCT/JP2014/081170, filed Nov. 26, 2014, which claims priority to Japanese patent application No. 2013-262426, filed Dec. 19, 2013, the disclosure of which are incorporated by reference in their entirety into this application.

BACKGROUND OF THE INVENTION

Field of the Invention

The present invention relates to a variable stator vane mechanism which adjusts the mounting angle of stator vanes of an axial flow compressor which is used in a gas turbine engine, a turbo refrigerator, or the like.

Description of Related Art

In a gas turbine engine, an axial flow compressor is used in order to compress gas. In the gas turbine engine, suctioned air is compressed by an axial flow compressor so as to have high pressure, and then is guided to a combustor. High-temperature and high-pressure gas burnt in the combustor is recovered as rotational energy by a turbine, and then discharged. During engine starting, the compressor of the gas turbine falls into an unstable phenomenon called rotating stall. If the gas turbine engine is operated for a long time in such an unstable state, start-up behavior results in failure.

As a measure to avoid this, in the compressor, a bleed technique in intermediate stages or a variable stator vane mechanism in former stages is adopted. Among these, in some variable stator vane mechanisms, a ring that supports stator vanes is driven by one or two actuators, to suppress variation in the angle of the stator vanes relative to the circumferential direction (Patent Documents 1, 2).

RELATED DOCUMENT

Patent Document

[Patent Document 1] JP Laid-open Patent Publication No. 2013-96341

[Patent Document 2] JP Laid-open Patent Publication No. 2010-1821

SUMMARY OF THE INVENTION

However, in the cases of the variable stator vane mechanisms shown in Patent Documents 1 and 2, a ring that supports stator vanes is movably supported by rollers such that the mounting angle of the stator vanes can be adjusted. Accordingly, the structure is complicated, resulting in high costs, wear of the rollers due to aged deterioration would be confirmed, and the frequency of replacement of the rollers is increased.

An object of the present invention is to provide a variable stator vane mechanism, for an axial flow compressor, which is excellent in durability, has a simple structure, and is realized at low cost.

In order to achieve the object, a variable stator vane mechanism according to the present invention is a variable stator vane mechanism configured to adjust a mounting angle of a stator vane of an axial flow compressor, the variable stator vane mechanism including: an arm coupled to the stator vane; a rotation ring coupled to one end portion of the arm and located at an outer surface of a casing of the axial flow compressor; a driving machine configured to rotate the rotation ring to cause the stator vane to pivot via the arm; and a friction pad mounted on the casing, wherein the rotation ring is in frictional contact with the friction pad.

According to this configuration, the rotation ring is rotated by the driving machine, and the stator vane pivots via the arm as a result of the rotation of the rotation ring, whereby the mounting angle of the stator vane is adjusted. At that time, since the rotation ring is in frictional contact with the friction pad mounted on the casing, excessive rotation of the rotation ring can be prevented and the mounting angle of the stator vane can be appropriately adjusted. In addition, rollers which will easily wear are not used, and the friction pad whose coefficient of friction is small is used. Thus, durability is excellent and the structure is simple, and thus, reduced costs can also be attained.

In the variable stator vane mechanism according to one embodiment of the present invention, the rotation ring may have a U-shaped cross section, and include an outer ring piece and an inner ring piece which face each other in a radial direction, and connecting piece connecting the outer and inner pieces, and the one end portion of the arm may be inserted between the outer ring piece and the inner ring piece, and the connecting piece may have a radially inner end portion in the form of a contact piece that is in contact with the friction pad. According to this configuration, excessive rotation of the rotation ring can be effectively prevented by a simple structure, and the mounting angle of the stator vane can be accurately adjusted.

In the variable stator vane mechanism according to one embodiment of the present invention, the one end portion of the arm is coupled to the rotation ring via a spherical bearing provided in the rotation ring. According to this configuration, when the arm pivots as a result of the rotation of the rotation ring, since the one end portion of the arm is coupled to the rotation ring via the spherical bearing provided in the rotation ring, the pivot movement of the arm is smooth.

In the variable stator vane mechanism according to one embodiment of the present invention, a shim may be inserted between the friction pad and the casing. According to this configuration, by using a shim having a different thickness, the height of the friction pad can be easily adjusted.

In the variable stator vane mechanism according to one embodiment of the present invention, the friction pad may be detachably mounted on the casing by the use of a fastening member, and the rotation ring may be formed with a tool insertion hole, through which a tool for manipulating the fastening member is to be inserted, at a position that is opposed to the fastening member and that is on a radially outer side relative to the fastening member. According to this configuration, by inserting a tool from the tool insertion hole and loosening the fastening member on the friction pad without disassembling the rotation ring and the arm, the friction pad or the shim can be easily replaced.

In the variable stator vane mechanism according to one embodiment of the present invention, the friction pad may be positioned so as to be detachable in a direction orthogonal to the radial direction in a state where the fastening member is loosened. According to this configuration, by inserting or pulling out the friction pad in a direction orthogonal to the radial direction, the friction pad can be easily and quickly attached/detached to/from the casing.

In the variable stator vane mechanism according to one embodiment of the present invention, the driving machine may be a single electric actuator and may be installed on an upper portion of the casing. According to this configuration, since an electric actuator is lighter in weight than a hydraulic cylinder in general, and in addition, is located above the casing, workability in assembling and disassembling the electric actuator is better, when compared with a case where the electric actuator is located in the small space below the casing.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Figure 1:
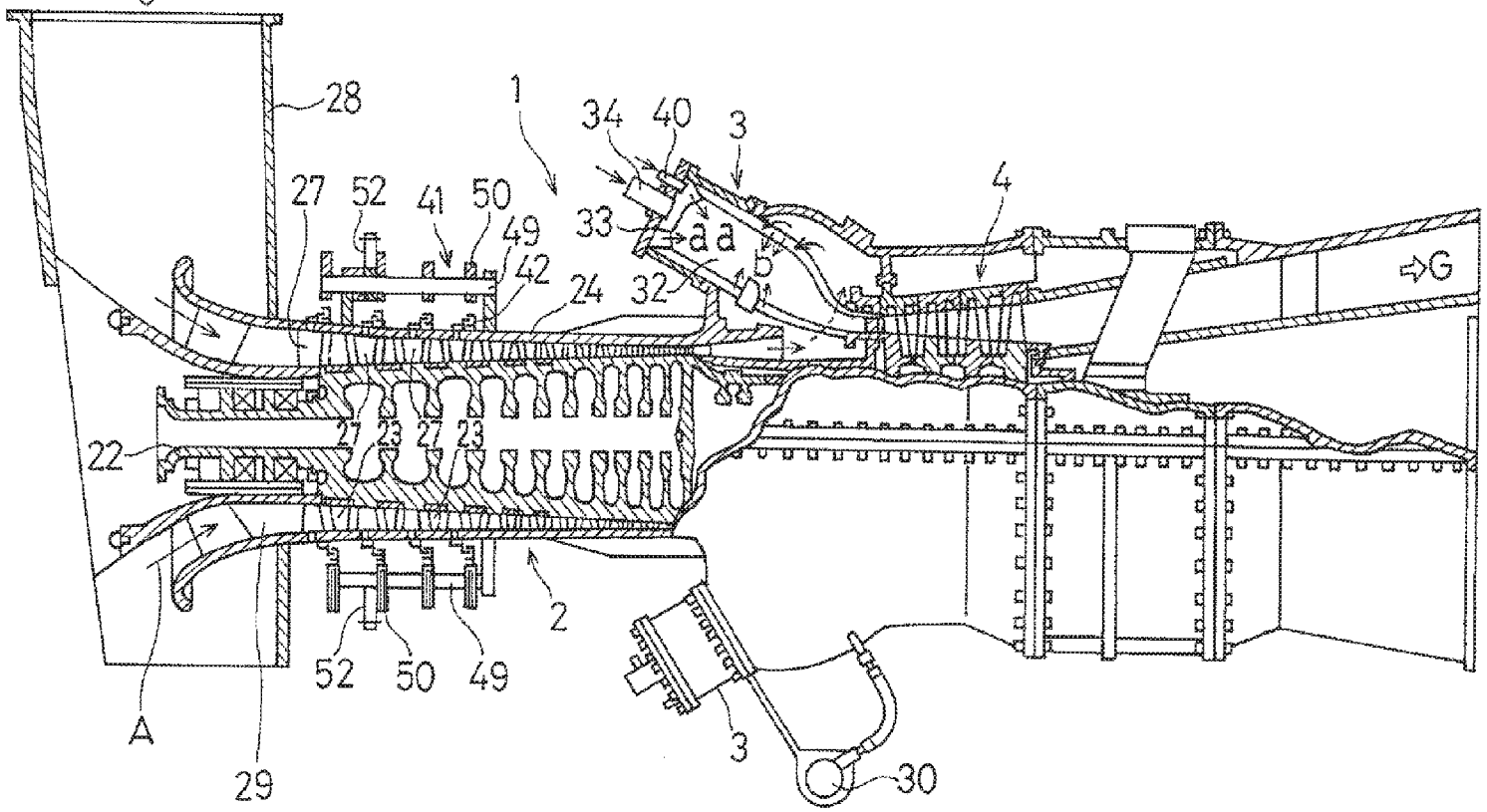
FIG. 1 is a partially cut schematic side view showing a gas turbine engine that employs a variable stator vane mechanism of the present invention.

Hereinafter, embodiments of the present invention will be described with reference to the drawings. FIG. 1 is a partially cut schematic side view of a gas turbine engine in which a variable stator vane mechanism is employed. A gas turbine engine 1 shown in FIG. 1 is configured such that: air is compressed in an axial flow compressor 2 and subsequently introduced into a combustor 3, and, at the same time, a gas fuel such as city gas is injected into the combustor 3 to cause a combustion therein; and then, a turbine 4 is driven by the energy of the resultant high-temperature and high-pressure combustion gas. The turbine 4 drives the axial flow compressor 2 and also drives a generator not shown.

The axial flow compressor 2 compresses air A which has been suctioned through an intake duct 28, by use of combination of a large number of rotor blades 23 provided on the outer peripheral surface of a rotary shaft 22 and stator vanes 27 provided in a plurality of stages on the inner surface of a casing 24, and supplies the compressed air to a chamber 29 formed in an annular shape.

A plurality of (six, for example) the combustors 3 are provided in the annular chamber 29 at equal intervals along the circumferential direction thereof. In the chamber 29, as indicated by arrows a, compressed air flows in from the distal end side to be made into a swirl flow by a swirler 33, and then, is guided to a combustion region in the combustor 3, and at the same time, as indicated by arrows b, a fuel is injected into the combustor 3 from a dilution hole (not shown) formed in the peripheral wall of the combustor 3. The fuel so injected is mixed with the compressed air to cause a combustion, and a high-temperature and high-pressure combustion gas G is sent to the turbine 4.

Figure 2:
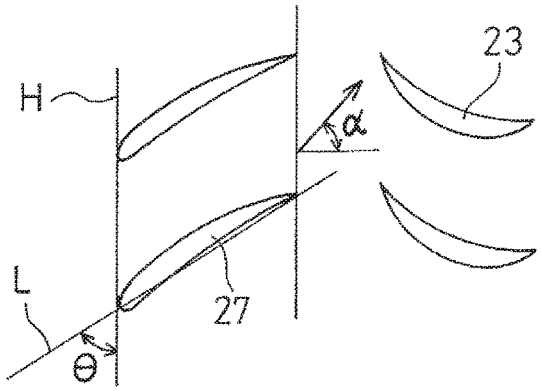
FIG. 2 is a cross-sectional view in the circumferential direction showing an arrangement of stator vanes of an axial flow compressor.

The axial flow compressor 2 is provided with a variable stator vane mechanism 41 as an air inflow rate adjustment mechanism which adjusts the air inflow rate. As shown in FIG. 2, the variable stator vane mechanism 41 is configured to adjust the air inflow rate for the axial flow compressor 2, by adjusting a mounting angle θ of each stator vane 27 in a cross section along the circumferential direction of the axial flow compressor 2 such that an outlet flow angle α of the stator vane 27 is changed. The mounting angle θ above is defined as an angle between a circumferential line H and a chord L (the line that connects the leading edge and the trailing edge) of the stator vane 27. By adjusting and changing the mounting angle θ so as to increase the outlet flow angle α, the axial velocity of air is decreased, and the air inflow rate to the axial flow compressor 2 is reduced. The variable stator vane mechanism 41 adjusts the mounting angle of the stator vanes 27 of four stages, i.e., from the most anterior stage to the fourth stage of the axial flow compressor 2.

Figure 3:
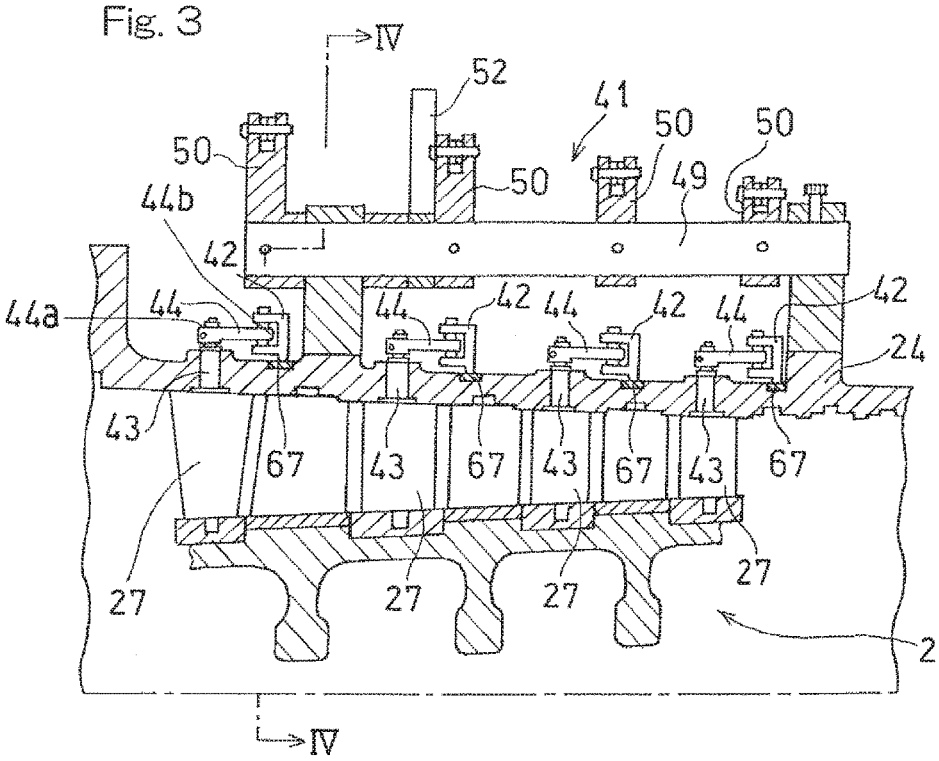
FIG. 3 is a longitudinal cross-sectional view showing in detail an enlarged view of the part of the variable stator vane mechanism shown in FIG. 1.

Next, the variable stator vane mechanism 41 according to a first embodiment will be described with reference to FIG. 3 which is a longitudinal cross-sectional view showing one portion thereof, and FIG. 4 which is a cross-sectional view along a line IV-IV shown in FIG. 3. As shown in FIG. 3, in this embodiment, assuming that a large number of stator vanes 27 arranged along the circumferential direction of the casing 24 of the axial flow compressor 2 form one stage, the mounting angles θ of the stator vanes 27 in four stages are adjusted in an interlocking manner. On an outer side of the casing 24, an annular rotation ring 42 having a U-shaped cross section is rotatably provided at a position close to the arrangement positions of the stator vanes 27 of each stage, along the circumferential direction thereof. Each of the stator vane 27 includes a central shaft 43 having a distal end (an upper end on the sheet of FIG. 3) to which a proximal end portion 44*a* of an arm 44 is fitted and fixed. The rotation ring 42 is coupled to one end portion 44*b*, which is the distal end portion, of the arm 44.

The rotation rings 42 of the respective stages are configured to be rotated in an interlocking manner, and a mechanism therefor will be described. A shaft 49 which extends along the axial direction of the axial flow compressor 2 is located outside the rotation rings 42 so as to extend over and across the rotation rings 42. The shaft 49 has opposite ends thereof rotatably supported by the casing 24. Four operation levers 50 are fixed to the shaft 49 so as to face the rotation rings 42, respectively.

Figure 4:
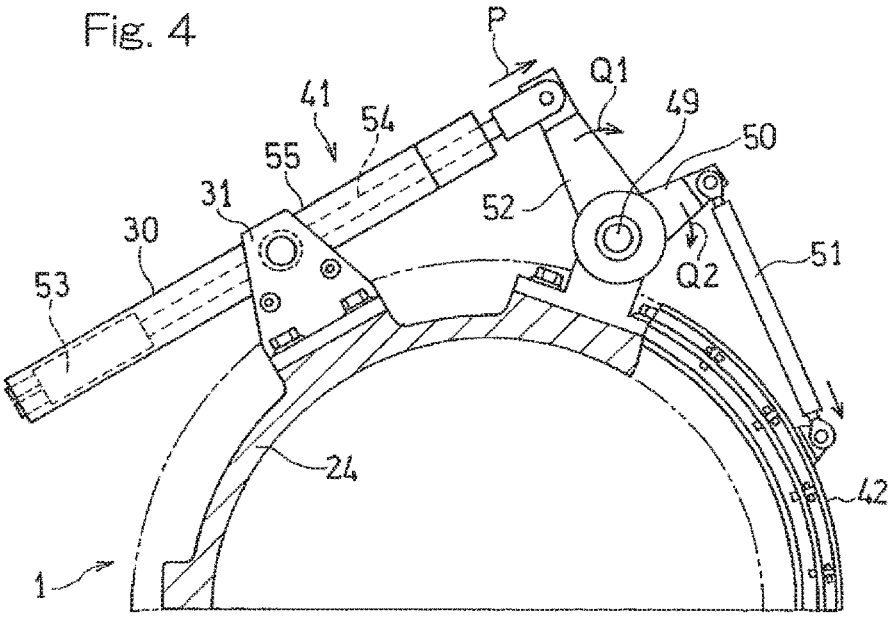
FIG. 4 is a cross-sectional view taken along a line IV-IV shown in FIG. 3.

As shown in FIG. 4, the free end of each operation lever 50 and its corresponding rotation ring 42 are coupled to each other by means of a turnbuckle 51 whose opposite ends are rotatably attached thereto, respectively. In addition, a proximal end portion of a single drive lever 52 is fixed to the shaft 49. An electric actuator 30 is coupled to the free end of the drive lever 52. The electric actuator 30 includes an electric motor 53, a rod 54 that is driven by the electric motor 53 for reciprocating motion, and a cylindrical case 55 that accommodates the electric motor 53 and the rod 54. The case 55 is supported by the outer surface of the casing 24 via a bracket 31, and a tip portion of the rod 54 is rotatably coupled to the free end of the drive lever 52.

Thus, when the electric motor 53 being a drive source of the variable stator vane mechanism 41 is operated, whereby the rod 54 advances in a direction P shown in FIG. 4, for example, the drive lever 52 pivots in the direction indicated by an arrow Q1 shown in FIG. 4 to cause the shaft 49 to rotate. Accordingly, each operation lever 50 fixed to the shaft 49 pivots in the direction indicated by an arrow Q2 shown in FIG. 4, to press, via the turnbuckle 51, its corresponding rotation ring 42 to thereby rotate the rotation ring 42. In this way, the stator vanes 27 of each stage coupled to its corresponding rotation ring 42 shown in FIG. 3 pivot in a mutually interlocked manner, whereby the mounting angle θ is adjusted to a predetermined mounting angle θ (FIG. 2).

The turnbuckle 51 shown in FIG. 4 is capable of adjusting the angle of the operation lever 50 by adjusting the length of the turnbuckle 51 at the time of installation. The mounting angles θ of all the stator vanes 27 in one stage that are coupled to one rotation ring 42 are adjusted by the same angle value. This adjustment angle is different from stage to stage, and for example, the lever ratio between the operation lever 50 and the drive lever 52, or the like is set such that the stator vanes 27 on the posterior stage side will have accordingly smaller adjustment angles.

Figure 5:
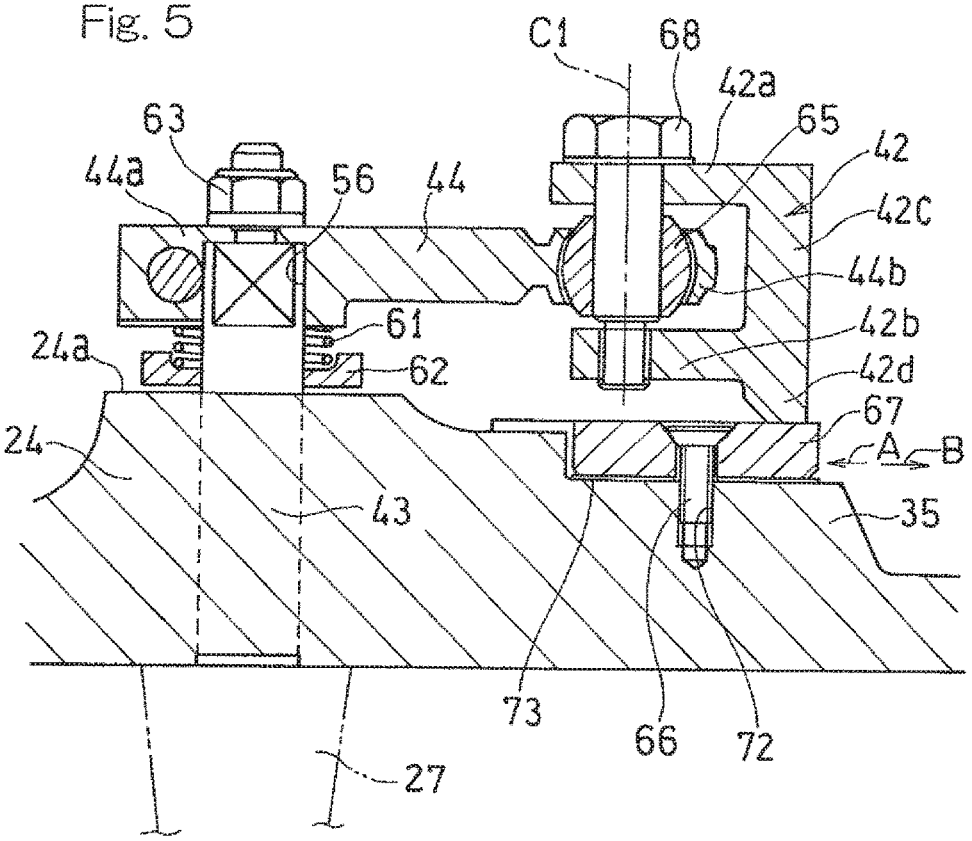
FIG. 5 is an enlarged view showing a portion of the variable stator vane mechanism of FIG. 3.

Details of the variable stator vane mechanism shown in FIG. 3 will be described with reference to FIG. 5 and FIG. 6. As shown in FIG. 5, the central shaft 43 provided in each stator vane 27 has an outer periphery fitted with a spring body 61 in the form of a coil spring and a receiving seat 62 therefor. The distal end of the central shaft 43 is fitted into a shaft hole 56 formed in the arm 44, and the proximal end portion 44*a* of the arm 44 and the central shaft 43 are coupled together by a fastening member 63 such as a nut. In this state, the spring body 61 suppresses the arm 44 from being inclined relative to a mounting surface 24*a* on the outer peripheral surface of the casing 24.

The rotation ring 42 having a U-shaped cross section has: an outer ring piece 42*a* and an inner ring piece 42*b* which face each other in the radial direction (up-down direction in FIG. 5); and a connection piece 42*c* which connects the outer and inner ring pieces 42*a* and 42*b*. The connection piece 42*c* had a radially inner end portion formed with a contact piece 42*d* protruding downward therefrom. One end portion 44*b* of the arm 44 is inserted between the ring pieces 42*a* and 42*b*, and is coupled to the rotation ring 42 via a spherical bearing 65 provided in the rotation ring 42. The spherical bearing 65 is supported at the rotation ring 42 by means of a shaft support member 68 such as a bolt having a center line C1 in the radial direction.

Figure 6:
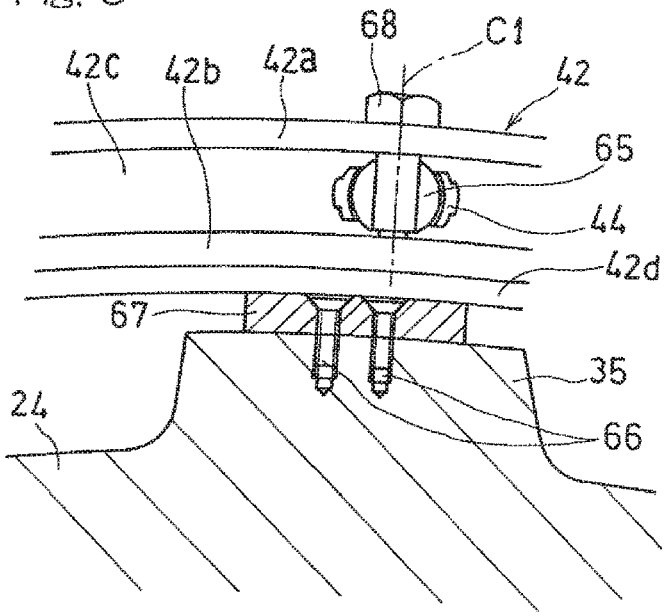
FIG. 6 is a front view of the variable stator vane mechanism.

As shown in FIG. 6, a friction pad 67 is detachably mounted on a base 35 provided on the outer peripheral surface of the casing 24, by means of fastening members 66 such as bolts. A plurality of the friction pads 67 are provided at intervals in the circumferential direction of the casing 24, for example, and preferably at equal intervals. In FIG. 6, eight friction pads 67 are provided at equal intervals in the circumferential direction of the casing 24. A contact surface which is the lower surface of the contact piece 42*d* of the rotation ring 42 is in contact with the outer surface of each friction pad 67. The rotation ring 42 is made of stainless steel, while the surface material of the friction pad 67 is a graphite-based solid lubricant, for example.

Figure 7:
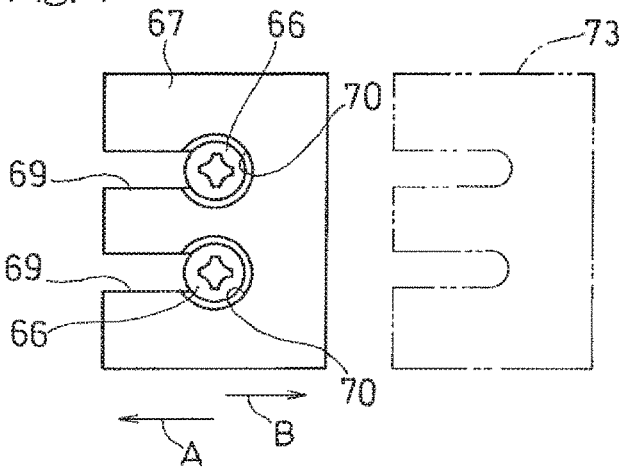
FIG. 7 is a plan view of a friction pad.

FIG. 7 is a plan view showing the friction pad 67. As shown in FIG. 7, a plurality of (two, for example) grooves 69 parallel to each other are formed in the friction pad 67 so as to extend from one side on the anterior side of the friction pad 67 to a center portion thereof. At the dead end of each groove 69, a recess 70 is formed in which a head portion of the fastening member 66 is to be inserted. The fastening member 66 is inserted in the groove 69 and then fastened into a screw hole 72 in the casing 24 shown in FIG. 5, whereby the friction pad 67 is mounted on the casing 24. Due to the groove 69, by loosening the fastening member 66, the friction pad 67 can be moved in directions A and B which are parallel to the groove 69, i.e., in a direction orthogonal to the radial direction of the gas turbine engine 1 (FIG. 1), whereby the friction pad 67 can be inserted under the rotation ring 42 and pulled out therefrom.

Figure 8A:
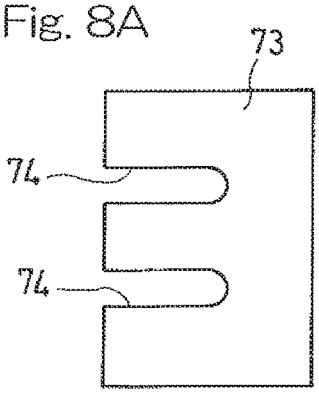
FIG. 8A is a plan view showing a shim.
Figure 8B:
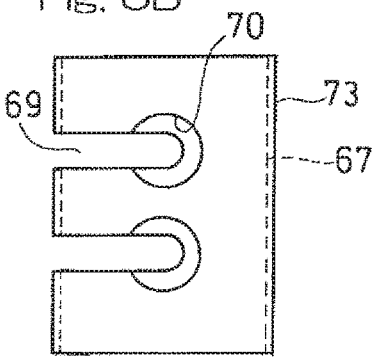
FIG. 8B is a plan view showing a state where the shim has been assembled.

FIG. 8A shows a shim 73. As shown therein, the shim 73 has substantially the same shape as that of the friction pad 67 (FIG. 7), and is formed with a plurality of (two, for example) grooves 74 parallel to each other. By inserting the shim 73 in a direction A under the friction pad 67 shown in FIG. 7, the shim 73 is set as shown in FIG. 8B. By changing the thickness of the shim 73 as appropriate, the height of the friction pad 67, i.e., the position in the radial direction of the outer surface of the friction pad 67 can be adjusted as desired. The direction A and the direction B match the axial direction of the gas turbine engine 1 (FIG. 1).

Figure 9:
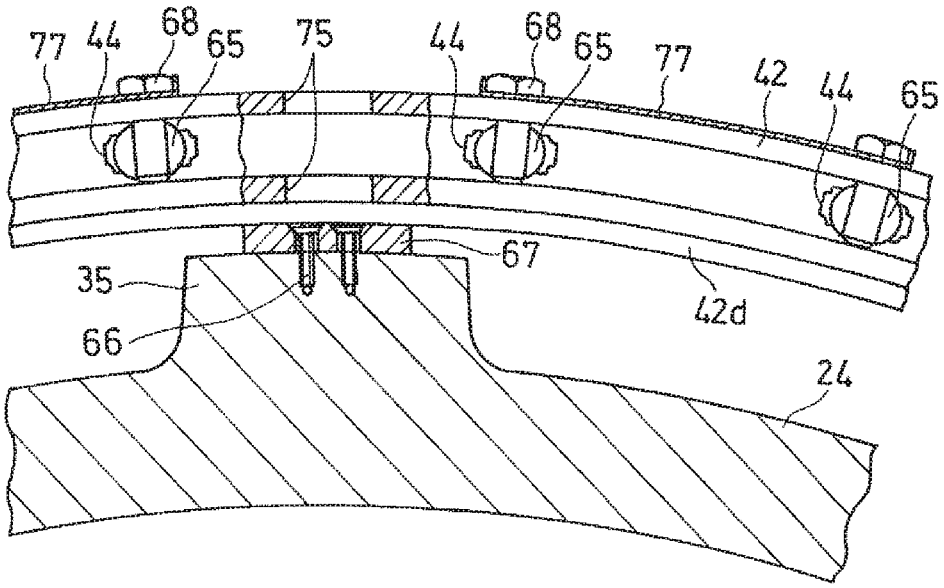
FIG. 9 is an enlarged side view of a state where a rotation ring is mounted to a casing.
Figure 10:
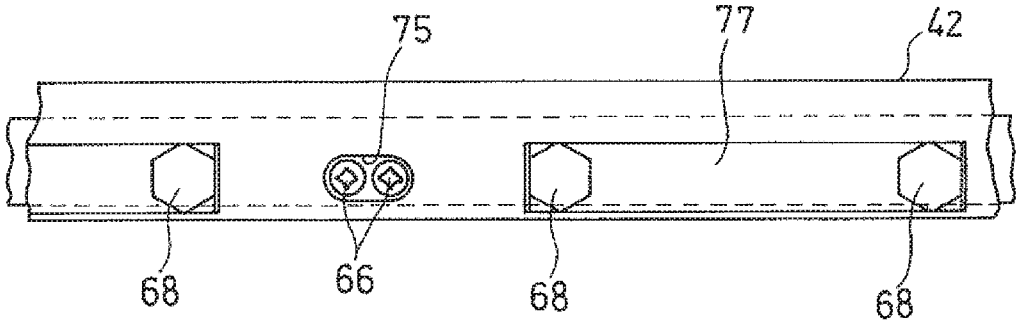
FIG. 10 is a plan view of FIG. 9.

FIG. 9 and FIG. 10 are front views each showing a second embodiment. As shown in FIG. 9, the friction pad 67 is mounted at a position between the spherical bearings 65, 65 in the casing 24, by means of the fastening members 66 such as bolts. Under a head portion of the shaft support member 68, a rotation prevention plate 77 which prevents rotation, in conjunction with an adjacent shaft support member 68, is mounted.

As shown in FIG. 10, the rotation ring 42 is formed with a tool insertion hole 75 in the form of a long hole elongated in the circumferential direction so as to penetrate the rotation ring 42, at a position that is opposed to the fastening members 66 and that is on the radially outer side relative to the fastening members 66. By inserting a tool such as a screwdriver from the tool insertion hole 75, the fastening members 66 are fasten or loosened. In a case where the friction pad 67 or/and the shim 73 is/are to be replaced when the friction pad 67 has worn, the fastening members 66 are loosened by the tool inserted through the tool insertion hole 75, whereby the friction pad 67 or the shim 73 can be easily replaced.

As described above, with respect to the variable stator vane mechanism 41 shown in FIG. 4, when the rotation ring 42 is rotated by the operation of the electric motor 53 and the mounting angle of each stator vane 27 shown in FIG. 3 is adjusted, the contact piece 42*d* of the rotation ring 42 shown in FIG. 5 rotates while being in frictional contact with the friction pad 67 mounted on the casing 24. Thus, excessive rotation of the rotation ring 42 is prevented by a large frictional resistance. Accordingly, the mounting angle of each stator vane 27 can be appropriately adjusted. In addition, rollers which will easily wear are not used and the friction pad 67 whose coefficient of friction is small is used. Thus, durability is excellent and the structure is simple, and thus, reduced costs can also be realized.

The rotation ring 42 has a U-shaped cross section, the one end portion 44*b* of the arm 44 is inserted between the outer ring piece 42*a* and the inner ring piece 42*b* which face each other in the radial direction, and the contact piece 42*d* which is in contact with the friction pad 67 is formed in an inner end portion in the radial direction of the connection piece 42*c* which connects the ring pieces 42*a* and 42*b*. Accordingly, excessive rotation of the rotation ring 42 can be effectively prevented by a simple structure, and the mounting angle of each stator vane 27 can be accurately adjusted.

Further, the one end portion 44*b* of the arm 44 is coupled to the rotation ring 42 via the spherical bearing 65 provided in the rotation ring 42. Thus, when the arm 44 pivots as a result of the rotation of the rotation ring 42, the arm 44 gets slightly inclined relative to the axial direction of the central shaft 43, but such an inclining movement can be smoothly performed.

The shim 73 is inserted between the friction pad 67 and the casing 24. Thus, if a shim 73 having a different thickness is used, the height of the friction pad 67 can be easily adjusted. In particular, when the friction pad 67 has worn, if the shim 73 is replaced with a shim 73 having a large thickness, the height of the friction pad 67, i.e., the position on the outer surface thereof, can be re-adjusted to an appropriate position.

In the second embodiment shown in FIG. 9, the tool insertion hole 75 through which a tool for operating the fastening members 66 is to be inserted is provided at a position, in the rotation ring 42, that is opposed to the fastening members 66 and that is on the radially outer side relative to the fastening members 66. Thus, by inserting a tool such as a screwdriver through tool insertion hole 75 and loosening the fastening members 66 without disassembling the rotation ring 42 and the arm 44, the friction pad 67 or the shim 73 can be easily replaced.

As shown in FIG. 7, the friction pad 67 and the shim 73 are detachable in a directions orthogonal to the radial direction in a state where each fastening member 66 (FIG. 6) is loosened. Thus, by inserting (direction A) or pulling out (direction B) the friction pad 67 in a direction orthogonal to the radial direction, the friction pad 67 can be easily and quickly attached/detached to/from the casing 24.

As shown in FIG. 4, the single electric actuator 30 is used as a driving machine for adjusting the mounting angle of the stator vanes 27 and the electric actuator 30 is installed on an upper portion of the casing 24. Since the electric actuator 30 is lighter in weight than a hydraulic cylinder in general, and in addition, is located above the casing 24, workability in assembling and disassembling the electric actuator 30 to the gas turbine engine 1 (FIG. 1) is better when compared with a case in which the electric actuator 30 is located at a lower portion of the casing 24 where the distance to the floor surface is small.

Although the present invention has been fully described in connection with the embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

1 . . . Gas turbine engine
2 . . . Axial flow compressor
22 . . . Rotary shaft
23 . . . Rotor blade
24 . . . Casing
27 . . . Stator vane
30 . . . Electric actuator (driving machine)
41 . . . Variable stator vane mechanism
42 . . . Rotation ring
42*a*, 42*b* . . . Ring pieces facing each other in radial direction
42*c* . . . Connection piece
42*d* . . . Contact piece
43 . . . Central shaft
44 . . . Arm
44*a* . . . One end portion
53 . . . Electric motor
65 . . . Spherical bearing
66 . . . Fastening member
67 . . . Friction pad
73 . . . Shim
75 . . . Tool insertion hole

What is claimed is:

1. A variable stator vane mechanism for adjusting a mounting angle of a stator vane of an axial flow compressor, the variable stator vane mechanism comprising:

an arm coupled to the stator vane;

a rotation ring coupled to one end portion of the arm and located at an outer surface of a casing of the axial flow compressor;

a driving machine configured to rotate the rotation ring to cause the stator vane to pivot via the arm; and a friction pad detachably mounted on the casing by the use of a fastening member, wherein the rotation ring is in frictional contact with the friction pad, and wherein the friction pad is formed with a plurality of grooves extending parallel to each other from an anterior side of the friction pad to a center portion of the friction pad so that the friction pad can be inserted and pulled out in a direction parallel to the grooves when the fastening member is loosened.

2. The variable stator vane mechanism as claimed in claim 1, wherein the rotation ring has a U-shaped cross section, and includes an outer ring piece and an inner ring piece which face each other in a radial direction, and connecting piece connecting the outer and inner pieces, and wherein the one end portion of the arm is inserted between the outer ring piece and the inner ring piece, and the connecting piece has a radially inner end portion in the form of a contact piece that is in contact with the friction pad.

3. The variable stator vane mechanism as claimed in claim 1, wherein the one end portion of the arm is coupled to the rotation ring via a spherical bearing provided in the rotation ring.

4. The variable stator vane mechanism as claimed in claim 1, wherein a shim is inserted between the friction pad and the casing.

5. The variable stator vane mechanism as claimed in claim 1, wherein the rotation ring is formed with a tool insertion hole, through which a tool for manipulating the fastening member is to be inserted, at a position that is opposed to the fastening member and that is on a radially outer side relative to the fastening member.

6. The variable stator vane mechanism as claimed in claim 5, wherein the friction pad is positioned so as to be detachable in a direction orthogonal to the radial direction in a state where the fastening member is loosened.

7. The variable stator vane mechanism as claimed in claim 1, wherein the driving machine is a single electric actuator and is installed on an upper portion of the casing.

* * * * *